US006247443B1

(12) United States Patent
Pelleja

(10) Patent No.: US 6,247,443 B1
(45) Date of Patent: Jun. 19, 2001

(54) ROTARY INTERNAL COMBUSTION ENGINE AND ROTARY INTERNAL COMBUSTION ENGINE CYCLE

(76) Inventor: Joseph Pelleja, 91 Leander Street, Brampton, Ontario (CA), L65 3N6

( * ) Notice: Subject to any disclaimer, the term of this patent is extended or adjusted under 35 U.S.C. 154(b) by 0 days.

(21) Appl. No.: 09/202,854

(22) PCT Filed: Jun. 10, 1997

(86) PCT No.: PCT/CA97/00403

§ 371 Date: Jun. 22, 1999

§ 102(e) Date: Jun. 22, 1999

(87) PCT Pub. No.: WO97/48885

PCT Pub. Date: Dec. 24, 1997

(30) Foreign Application Priority Data

Jun. 19, 1996 (CA) ..... 2179468

(51) Int. Cl.[7] ..... F02B 53/00

(52) U.S. Cl. ..... 123/229; 123/230; 123/231; 418/186; 418/263

(58) Field of Search ..... 123/229, 230, 123/231, 243; 418/260, 263, 186, 187

(56) References Cited

U.S. PATENT DOCUMENTS

| | | | | |
|---|---|---|---|---|
| 1,309,767 | * | 7/1919 | Morgan | 123/229 |
| 3,762,375 | * | 10/1973 | Bentely | 123/243 |
| 3,865,085 | * | 2/1975 | Stenberg | 123/229 |
| 5,937,820 | * | 8/1999 | Nagata et al. | 123/243 |

FOREIGN PATENT DOCUMENTS

| | | | | |
|---|---|---|---|---|
| 648 293 | | 9/1964 | (BE) . | |
| 448226 | * | 5/1948 | (CA) | 123/229 |
| 1248029 | | 1/1989 | (CA) . | |
| 2059416 | * | 8/1971 | (DE) . | |
| 2159594 | * | 6/1973 | (DE) . | |
| 2301666 | * | 7/1974 | (DE) . | |
| 595689 | * | 7/1925 | (FR) . | |
| 606011 | * | 2/1926 | (FR) | 123/229 |
| 716754 | * | 10/1931 | (FR) | 123/231 |
| 755096 | * | 9/1933 | (FR) | 123/243 |

* cited by examiner

*Primary Examiner*—Michael Koczo
(74) *Attorney, Agent, or Firm*—Walter W. Duft

(57) ABSTRACT

An internal combustion rotary engine (1) comprises an engine casing (300) in which is rotatably mounted a cylindrical rotor assembly (2) co-axially fixed to a drive shaft (6). The rotor (3) receives a plurality of reciprocating vanes (9, 10, 11) in a staggered and radial arrangement. These vanes (9, 10, 11) are connected to cam axels (13, 14, 15) which in turn impart and control their reciprocating movements through a slidable engagement with cam pathways. The reciprocating movements of the vanes define the working chambers of the engine as the rotor rotates.

29 Claims, 20 Drawing Sheets

ROTARY INTERNAL COMBUSTION ENGINE AND ROTARY INTERNAL COMBUSTION ENGINE CYCLE

FIELD OF THE INVENTION

The present invention relates to internal combustion engines and in particular a rotary internal combustion engine and rotary internal combustion engine cycles.

BACKGROUND OF THE INVENTION

The rotary internal combustion engine and cycle is superior in many ways to the conventional reciprocating piston-type engine. They possess fewer parts, are of low weight, simple in design, have superior breathing and therefore greater efficiency, have no valves and do not experience a reciprocating imbalance. Various designs of rotary internal combustion engines are known most of which comprise a rotor eccentrically mounted within a rotor chamber. In many, the rotor has a plurality of slots fitted with sliding vanes in order to create the working chambers of the engine as the rotor rotates within the rotor chamber. However, there are numerous shortcomings associated with the known art such as inadequate sealing between the working chambers of the engine leading to combustion gas leakage between working chambers of the engine, the premature retraction of the radially mounted members, complexity of design, inordinate frictional wear of component parts, and an inefficient conversion of chemical energy to mechanical energy.

One example of the known art is Canadian Letters Patent 1,248,029 entitled "Rotary Internal Combustion Engine" issued on Sep. 3, 1981 to Aase. The Aase patent discloses an engine which relies upon a very complex rotor design, comprising sliding cylinder sleeves within the rotor receiving members that define the working chambers of the engine. This design is very complex and hence may be very expensive to manufacture. Furthermore there are a large number of moving parts in the engine design all of which are subject to frictional wear. Finally, the size of the combustion chamber is limited and therefore the conversion of chemical fuel energy to mechanical rotational energy may be less than optimal.

The present invention seeks to overcome the disadvantages of known internal combustion rotary engines.

SUMMARY OF THE INVENTION

An object of the present invention is to provide an improved rotary internal combustion engine and an improved rotary internal combustion engine cycle.

In accordance with one aspect of the present invention there is provided a rotary internal combustion engine comprising an engine casing within which is mounted a cylindrical rotor co-axially fixed to a drive shaft and adapted to receive a plurality of slidable and retractable vanes. The rotor is eccentrically and rotatably mounted inside a circular rotor chamber. In cross-section, the rotor chamber wall is thicker at the side at which combustion takes place to accommodate the pressures resulting from the combusting fuel/air mixture. The slidable retractable vanes are mounted in the rotor in a staggered and radial arrangement substantially forming a "Y" shape in cross-section. Cams are coupled to the sliding and retracting vanes by connecting rods to control their sliding and retracting movements. These sliding and retracting movements define the working chambers of the engine as the rotor rotates. The working chambers comprise a fuel/air mixture intake chamber, a compression chamber, a combustion chamber and an exhaust chamber.

In one embodiment of the present invention, there is provided a fuel/air mixture supply using either carburation or fuel injection means for providing a suitable fuel/air mixture to the intake and combustion chambers. The fuel/air mixture is ignited using a spark plug or compression ignition means. Conveniently, gaseous products of combustion are removed from the engine through an exhaust gas system comprising a series of interconnected orifices and ports and an intake/exhaust vane. The moving engine parts are adequately lubricated. Those portions of the engine which are in communication with each other and require to be sealed in order for the engine to operate are so sealed.

The engine also has a coolant circulating system to remove combustion heat from the engine in operation.

In accordance with another aspect of the present invention there is provided a rotary internal combustion engine cycle wherein the operation thereof is defined by the following phases: intake phase, compression phase, combustion and power phase and exhaust phase. The combustion phase occurs over at least 180 degrees of rotor rotation and as much as 200 degrees of rotation. All four phases are repeated over each cycle of 360 degrees of rotation.

Advantages of the present invention are a more efficient conversion of chemical fuel energy to mechanical energy by the increased combustion phase over at least 180 degrees of rotation; fewer mechanical parts to wear; sealing and anti-friction means to further improve the operation of the engine.

BRIEF DESCRIPTION OF THE DRAWINGS

The present invention will be further understood from the following description with references to the drawings in which.

DETAILED DESCRIPTION

Figure 1:
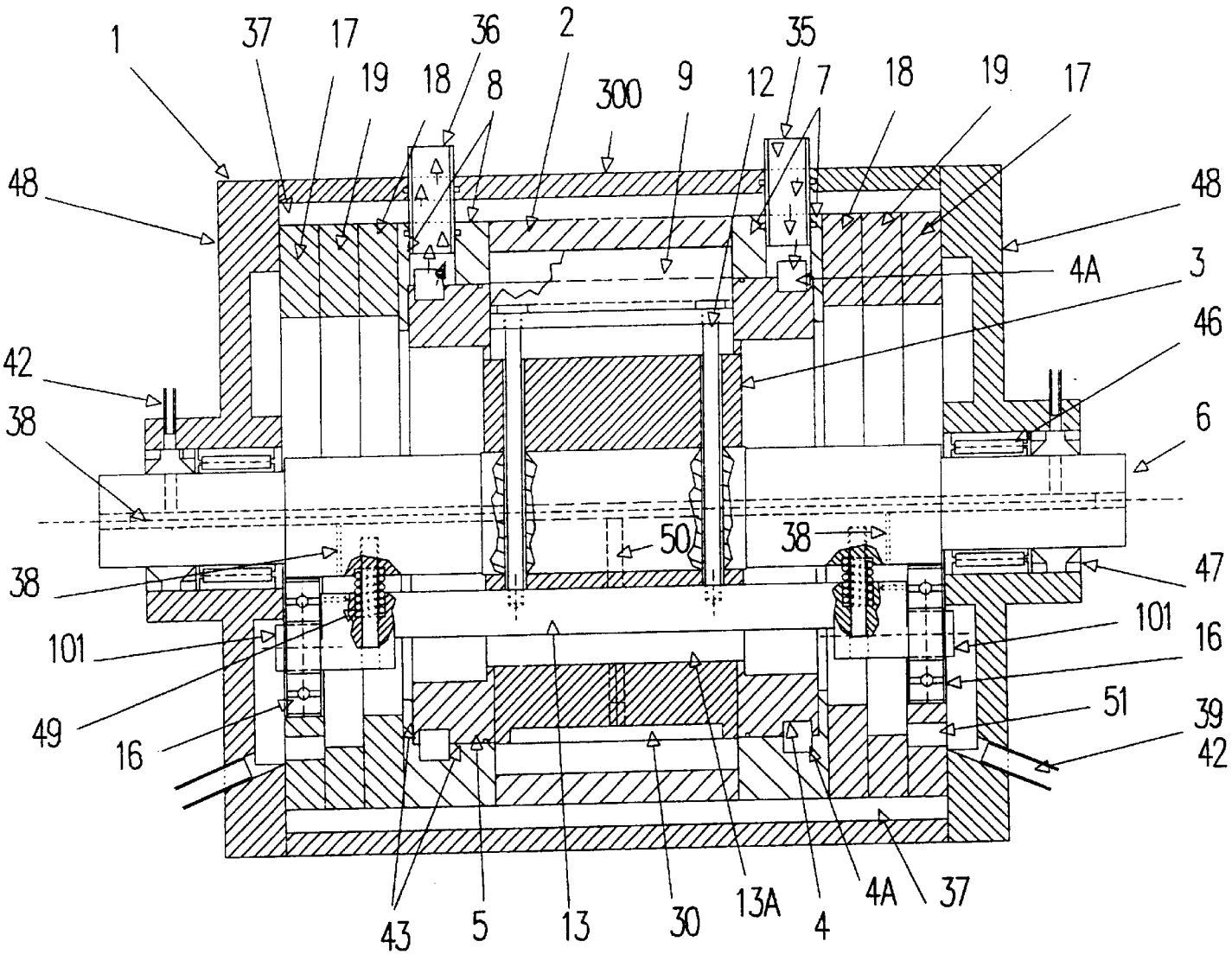
FIG. 1 is a cross-sectional axial view of an embodiment of the present invention showing the intake-exhaust vane at 90 degrees of rotation.

Referring to FIG. 1 there is illustrated a rotary internal combustion engine assembly (1) in accordance with an embodiment of the present invention. The engine comprises a engine casing (300). The ends of the engine casing are closed by way of main shaft bearing housings (48), is apertured at their center to receive ends of rotor shaft (6). A cylindrical rotor (3) is co-axially mounted on the shaft (6). The ends of the shaft (6) are bevelled and the bevelled ends are mounted on main shaft bearings (46) housed in main shaft bearing housings (48). Oil seals (47) are provided to seal the ends of the shaft against the main shaft bearing housing. Engine rotor (3) is mounted eccentrically within circular rotor chamber (2). Within each of the ends of the engine casing (300) are located cams (17 intake/exhaust, 18 torque and 19 pressure containment).

Figure 2:
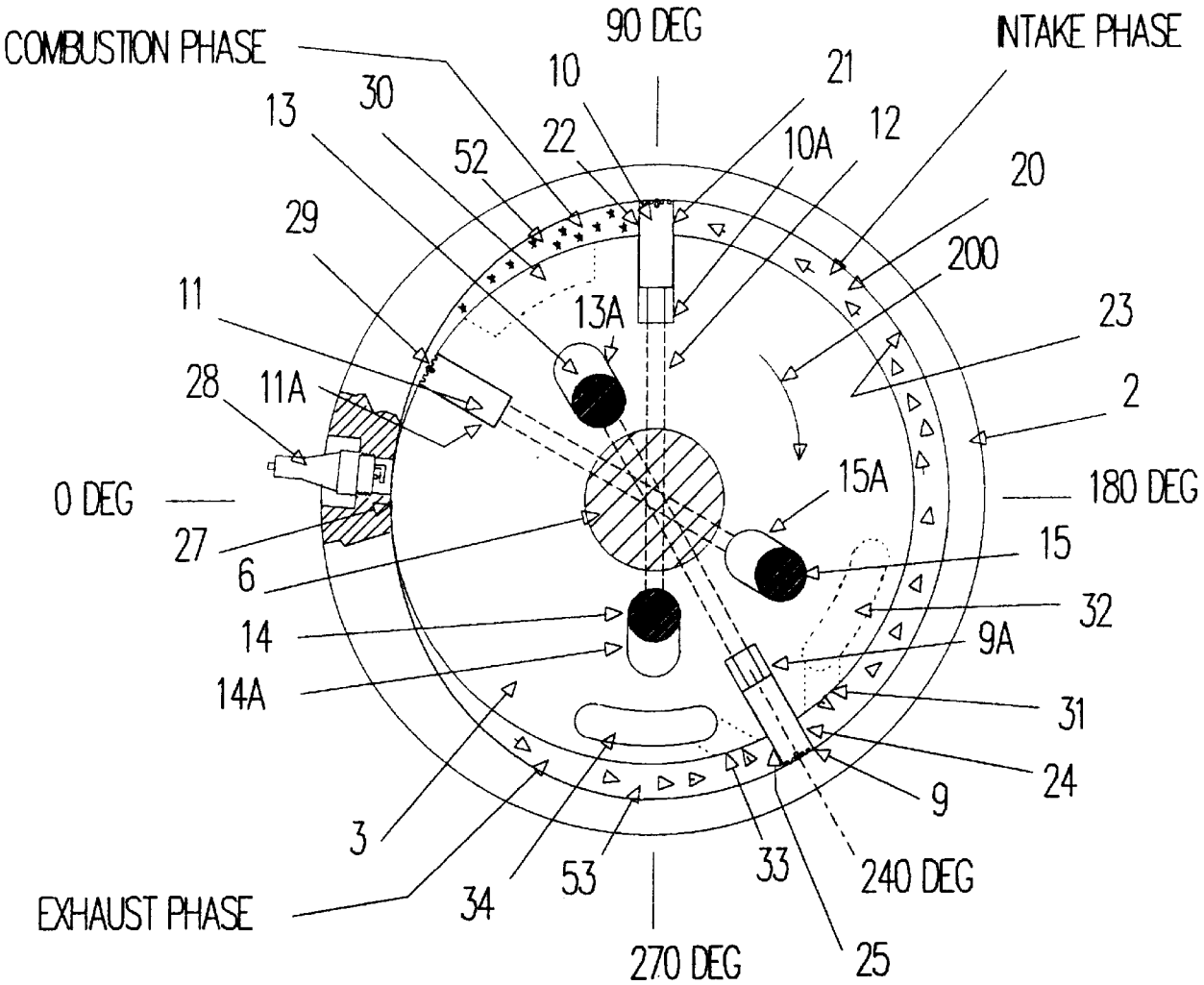
FIG. 2 is a cross-sectional radial view of the embodiment of FIG. 1 showing the torque vane at 90 degrees of rotation.

Referring to FIG. 2, the rotor (3) has slots (9A, 10A and 11A) to receive slidable and retractable vanes (9, 10 and 11). As more fully described below, the vane (9) functions as the intake/exhaust vane, the vane (10) functions as the torque vane and the vane (11) functions as the pressure containment vane. The rotor (3) is eccentrically and rotatably mounted inside a circular rotor chamber (2) such that the rotor, as it rotates in the direction of the arrow (200), is in continual sliding contact with the inside wall of the rotor casing (23) at the rotor/rotor casing seal (27). Sealing is accomplished using a close tolerance gap between the rotor and the rotor casing. A TEFLON™ or other type of inorganic seal is installed at point (27). The rotor is also notched at (30) which, as more filly described below, forms part of the combustion chamber. Combustion takes place at the rotor/rotor casing seal (27) below the spark plug (28). Since this is the area in which the rotor casing will experience the greatest pressures, the casing is thicker here than elsewhere to withstand these pressures. FIG. 2 also shows intake orifice (32).

Slidable, retractable vanes (9, 10, 11) are connected to respective cam axles (13, 14 and 15) by connecting rods (12). Cam axles (13, 14 and 15) are contained in bores (13A, 14A and 15A respectively). Due to the elongated shape of the bores, cam axles (13, 14 and 15) are permitted a reciprocating motion within bores (13A, 14A and 15A). This reciprocating motion is transmitted to the vanes by the connecting rods as a sliding motion causing the vanes to extend out of or retract into their respective slots. This in turn defines the working chambers of the engine as the rotor rotates, as more fully described below.

In operation, the rotary internal combustion engine includes an intake phase, compression phase, combustion and power phase and exhaust phase.

The Intake Phase

Figure 3:
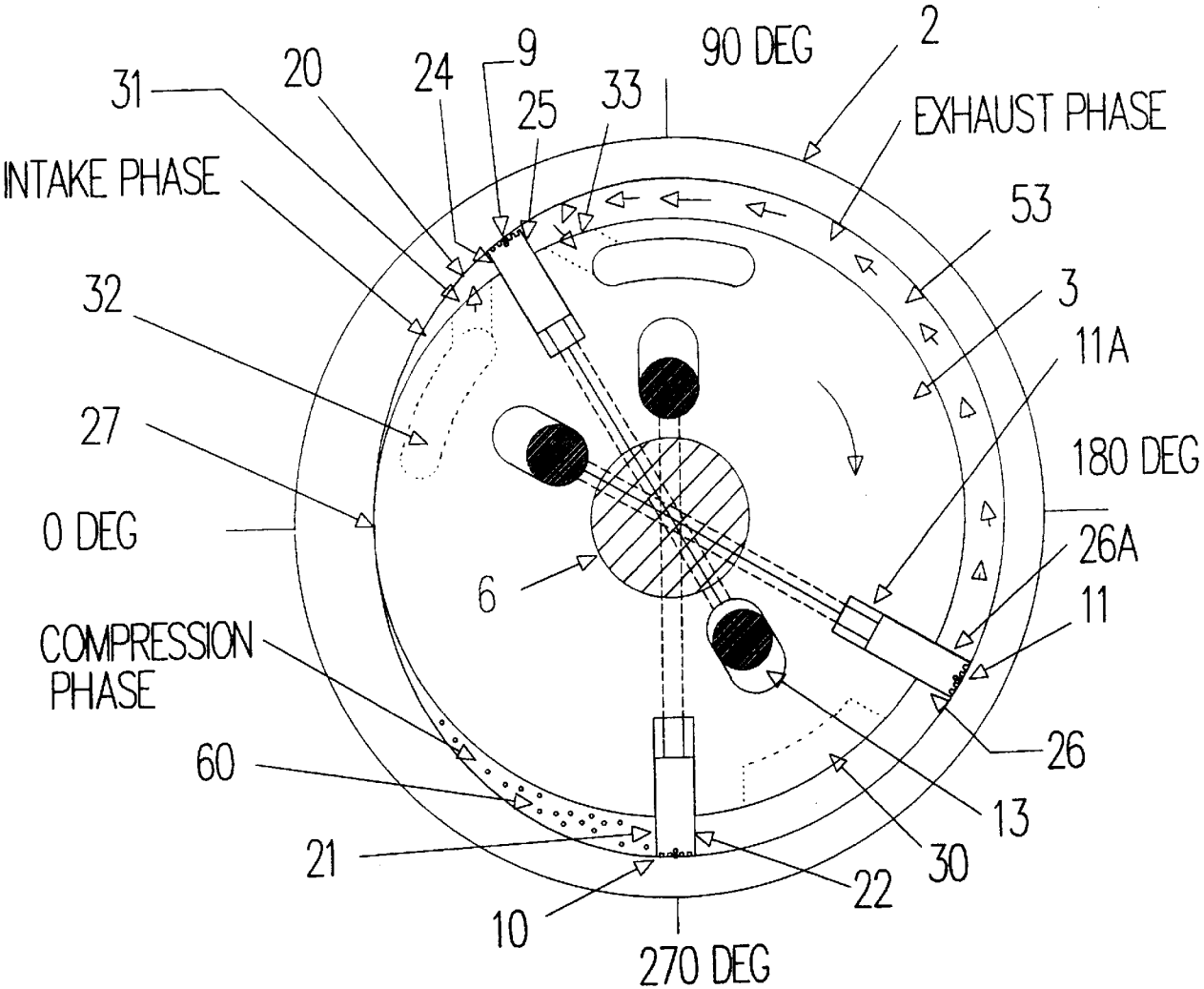
FIG. 3 is a cross-sectional radial view of one embodiment of FIG. 1 showing the torque vane at 270 degrees of rotation.

As indicated above, and referring to FIG. 2, the working chambers of the engine are defined by the operative relationship between the rotating rotor (3), the slidable retractable vanes (9, 10 and 11) and the cam axles (13, 14 and 15). Referring to FIG. 3, the intake phase commences as the intake/exhaust vane (9) has sweeps past the "0" degree point (27). As the rotor (3) rotates, intake chamber (20) increases in volume, creating a partial vacuum, drawing a fuel/air mixture into the intake chamber (20) by way of an intake orifice (31) in serial communication with intake port (32), intake ring (Shown in FIG. 10A as Item 4) and intake rube (Shown in FIG. 10A as Item 35). The volume of the intake chamber (20) is initially defined as the volume between the lagging face (24) of the intake/exhaust vane (9) and the rotor/rotor casing seal (27).

Figure 4:
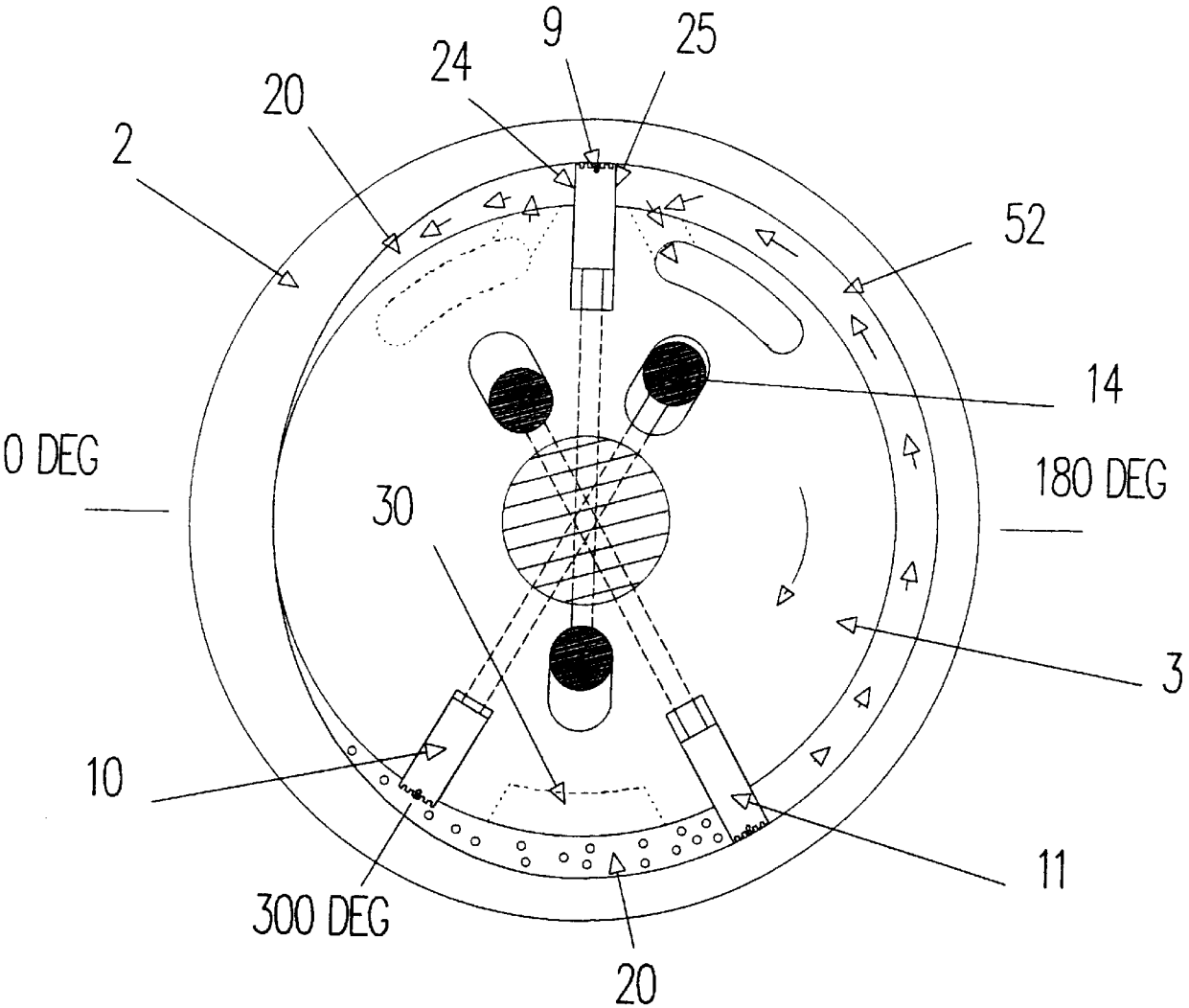
FIG. 4 is a cross-sectional radial view of one embodiment of FIG. 1 showing the torque vane at 300 degrees of rotation.

In FIG. 4, the intake/exhaust vane (9) is shown having advanced to the 90 degree position. The distal end of vane (9) remains in sliding and sealing contact with the inside wall of the rotor casing. The volume of the intake chamber continues to expand drawing in more fuel/air mixture as shown.

Figure 5:
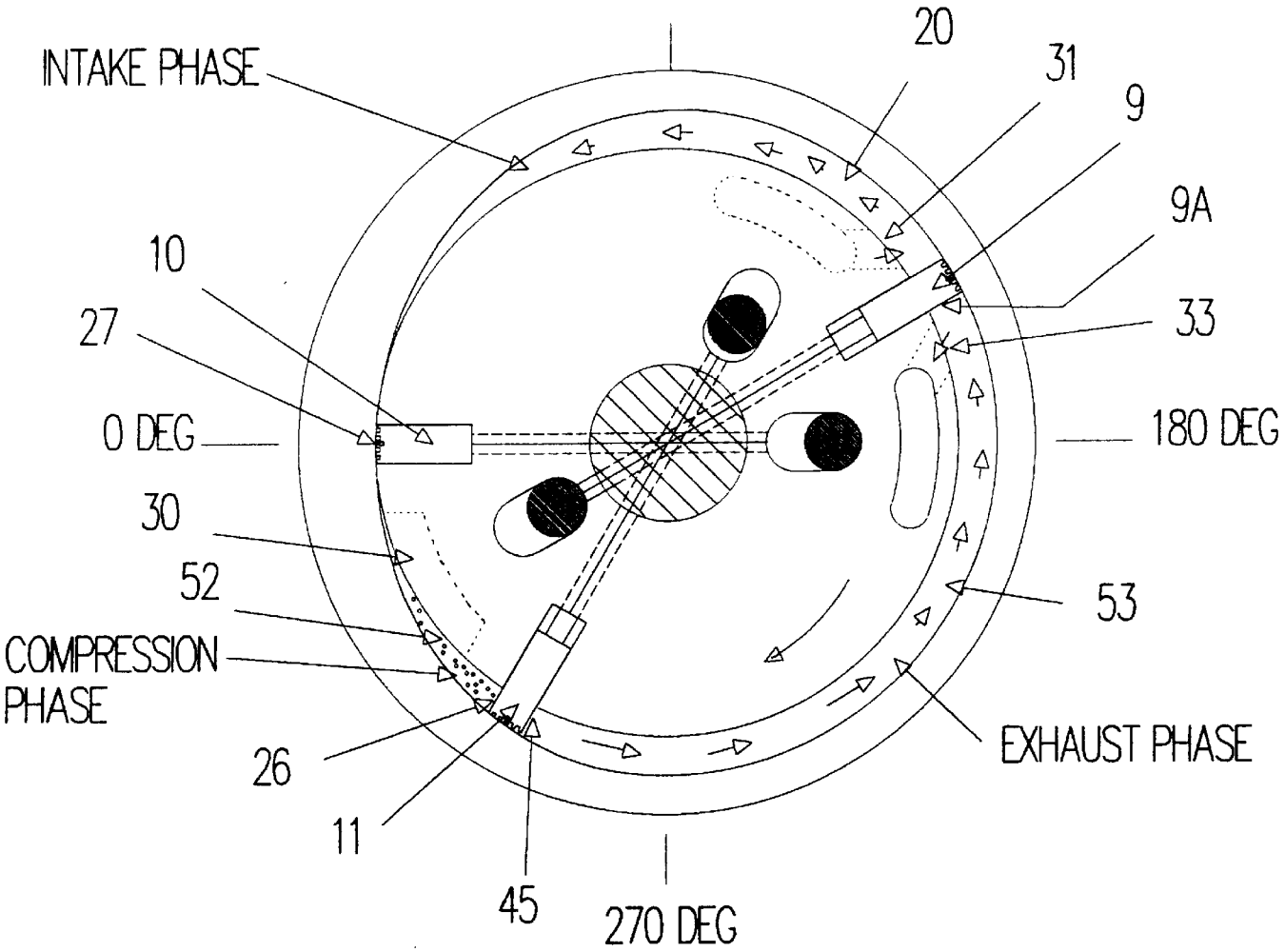
FIG. 5 is a cross-sectional radial view of one embodiment of FIG. 1 showing the torque vane at 0 degrees of rotation.

Referring to FIG. 5, the volume of the intake chamber (20) continues to expand as rotor (3) rotates.

Figure 6:
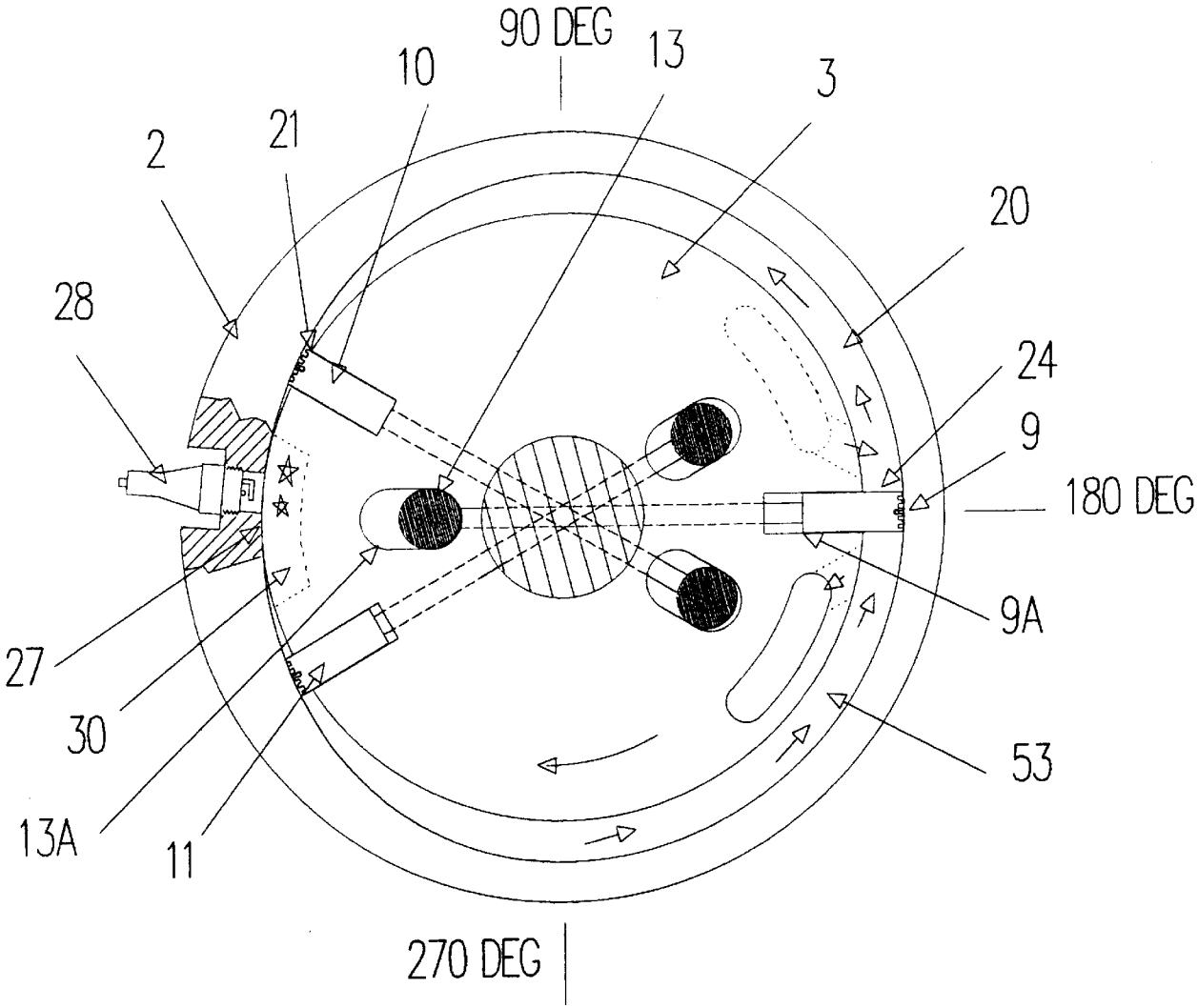
FIG. 6 is a cross-sectional radial view of one embodiment of FIG. 1 showing the intake/exhaust vane at 180 degrees of rotation.
Figure 7:
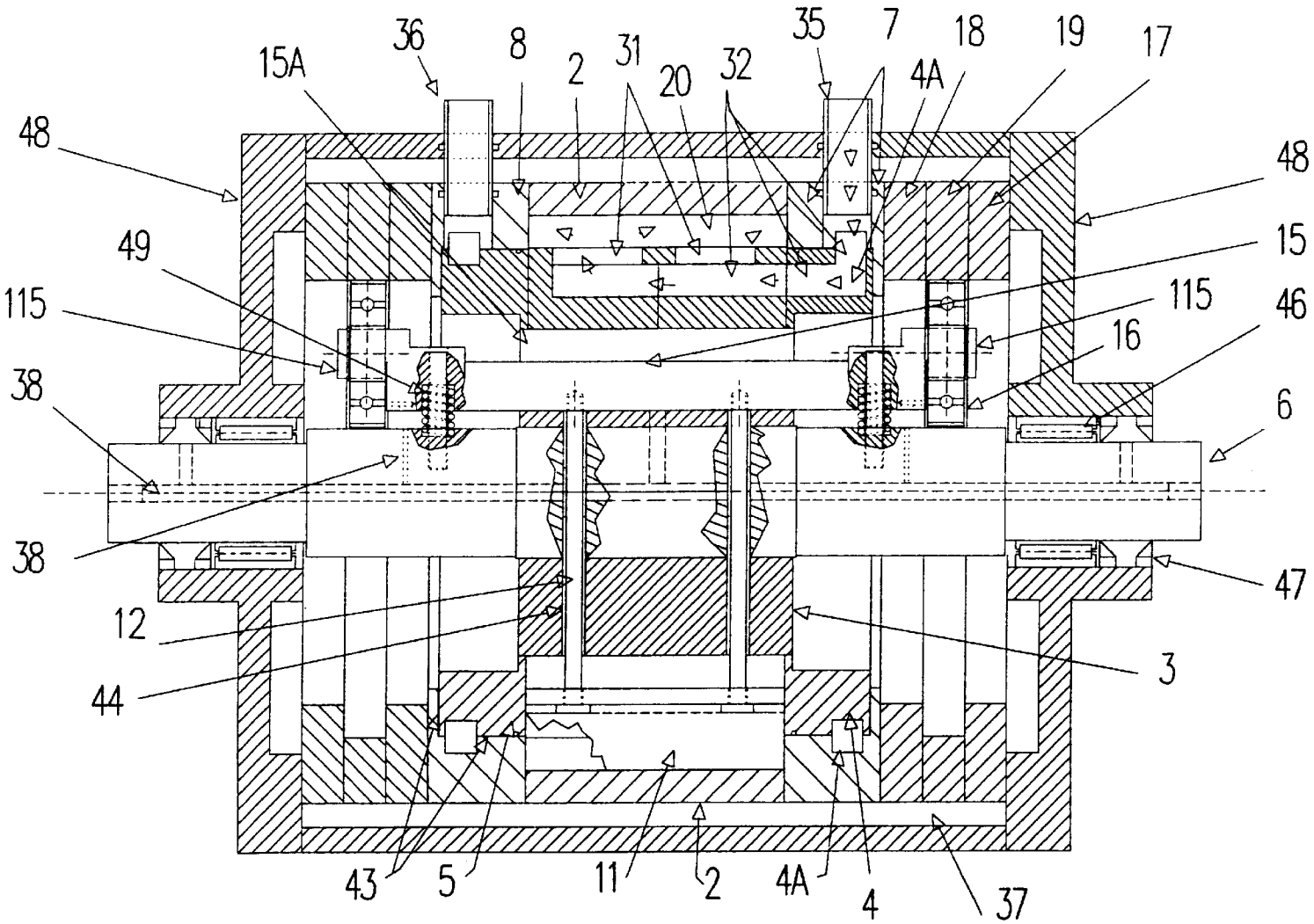
FIG. 7 is a cross-sectional axial view of one embodiment of FIG. 1 showing the pressure containment vane at the bottom end of its travel.

Referring to FIG. 6, the intake/exhaust vane (9) has advanced to the 180 degree position. The distal end of intake/exhaust vane (9) remains in sealing contact with the inside surface of the rotor chamber. Vane (9) is at its maximum extension from its slot (9A). Cam 13 is at its maximum inboard position within bore (13A). Torque vane (10) has swept past the "0" degree point (27) and the volume of the intake chamber (20) is now defined as the volume between the leading face (21) of torque vane (10) and the lagging face (24) of intake/exhaust vane (9).

The intake chamber is endosed on its sides by the engine stationary intake case (Shown in FIG. 1 as Item 7) and the engine stationary exhaust case (Shown in FIG. 1 and Item 8).

Referring to FIG. 2, the intake/exhaust vane (9) is now located at the 240 degree position. The torque vane (10) is at the 90 degrees position. The volume of the intake chamber (20) is at its maximum volume. As more fully described below, the compression phase will now commence. Intake port (32) and intake orifice (31) are no longer in communication with intake ring (Shown in FIG. 1 as Item 4) and the intake chamber is sealed for pressurization.

Figure 10:
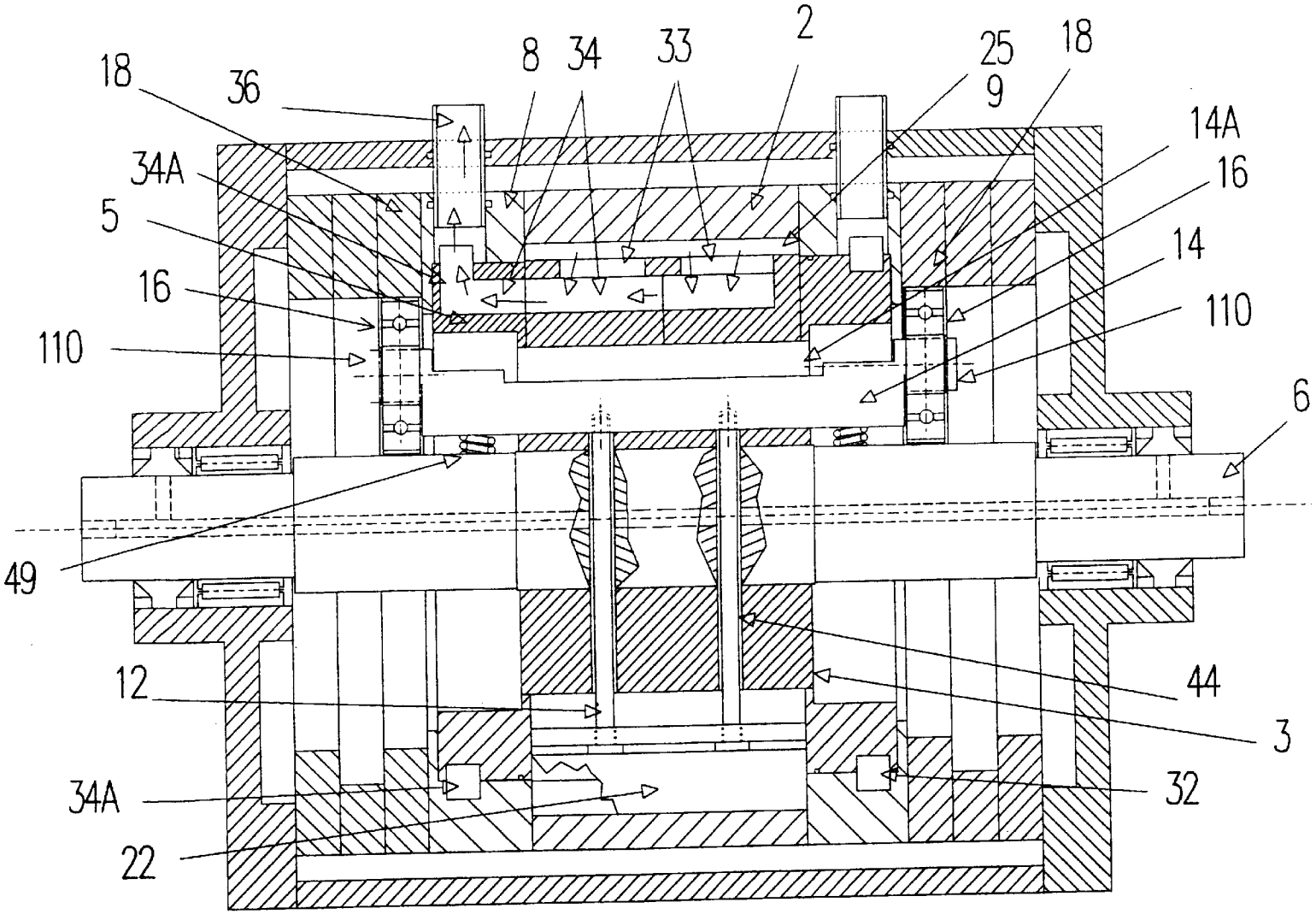
FIG. 10 is a cross-sectional axial view of one embodiment of FIG. 1
Figure 10A:
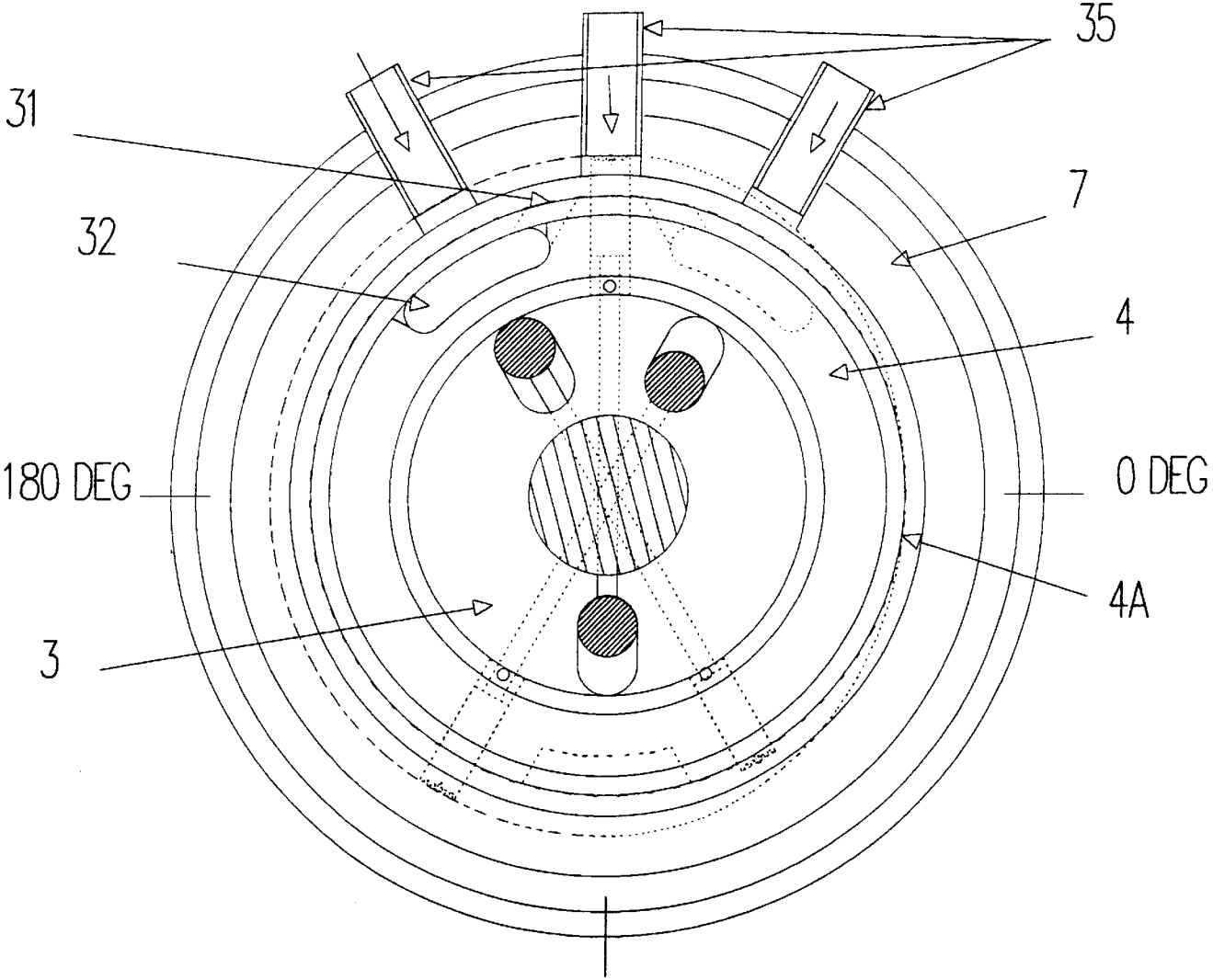
FIG. 10A is a cross-sectional radial view of one embodiment of FIG. 1 showing the flow of intake gases.

Additional details of the fuel/air intake phase are described with reference to FIG. 1 and FIG. 10A. A fuel/air mixture is provided by way of carburation means or fuel injection mean into intake tubes (35). Intake tube (35) penetrates rotor intake case (7) and is in constant communication with rotor ported intake annulus (4A). Intake annulus (4A) is within rotor intake case (7). Intake orifice (31) in the rotor (3) is in communication with intake port (32). As the rotor rotates during the intake phase, rotor intake port (32) remains in communication with intake annulus (4A) drawing the fuel/air mixture into the intake chamber (20).

The Compression Phase

Figure 8:
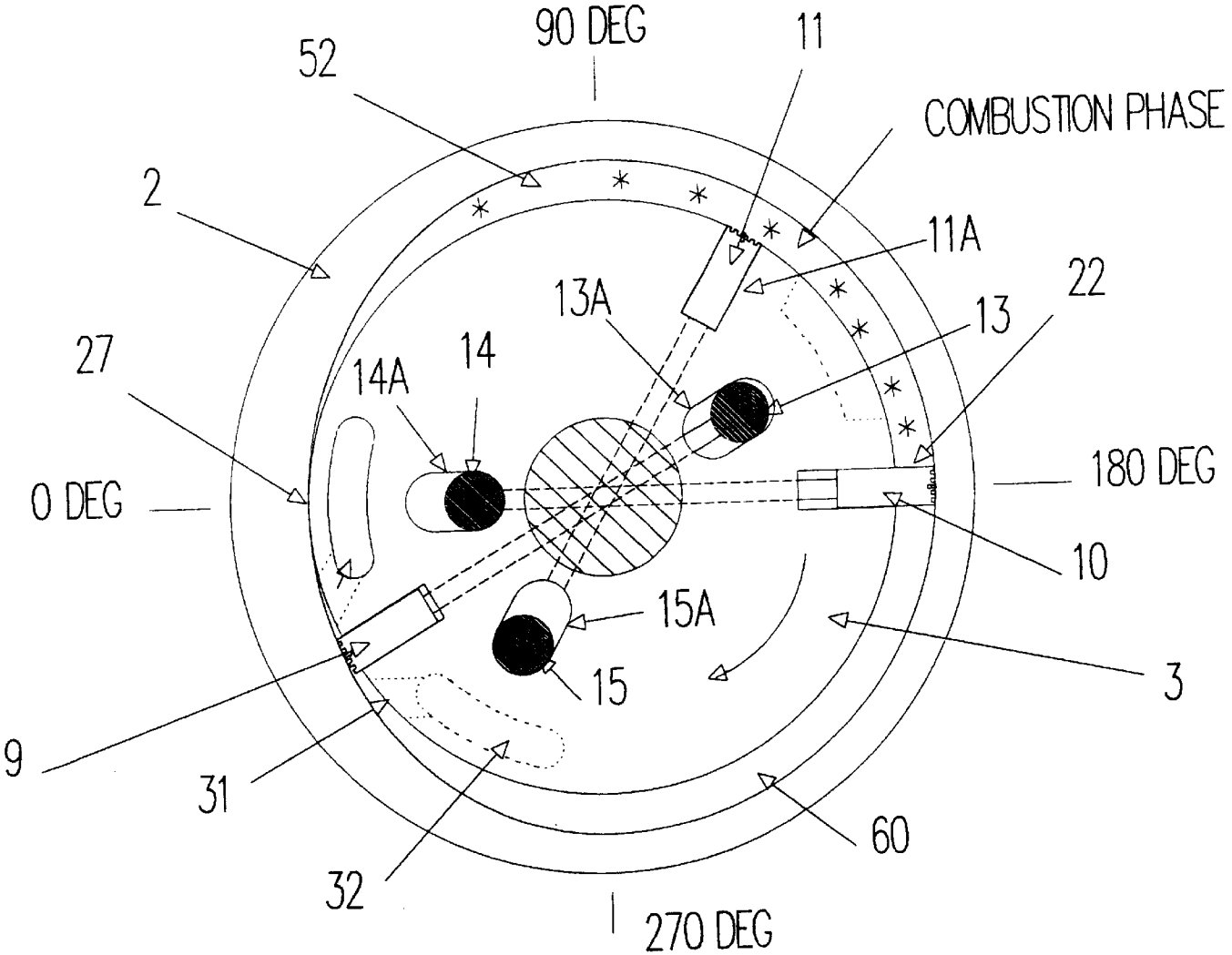
FIG. 8 is a cross-sectional radial view of one embodiment of FIG. 1 showing the torque vane at 180 degrees of rotation.

Referring to FIG. 8, the intake/exhaust vane (9) sweeps towards the rotor/rotor casing seal (27) at the "0" degree position and the torque vane (10) is at the 180 degree position. The volume of the sealed compression chamber (60) is decreasing and the fuel/air mixture therein is becoming pressurized. The intake orifice (31) and intake port (32) are no longer in communication with the intake annulus (Shown in FIG. 1 as Item 4). Pressure containment vane (11) is in its retracted position within slot (11A).

Figure 9:
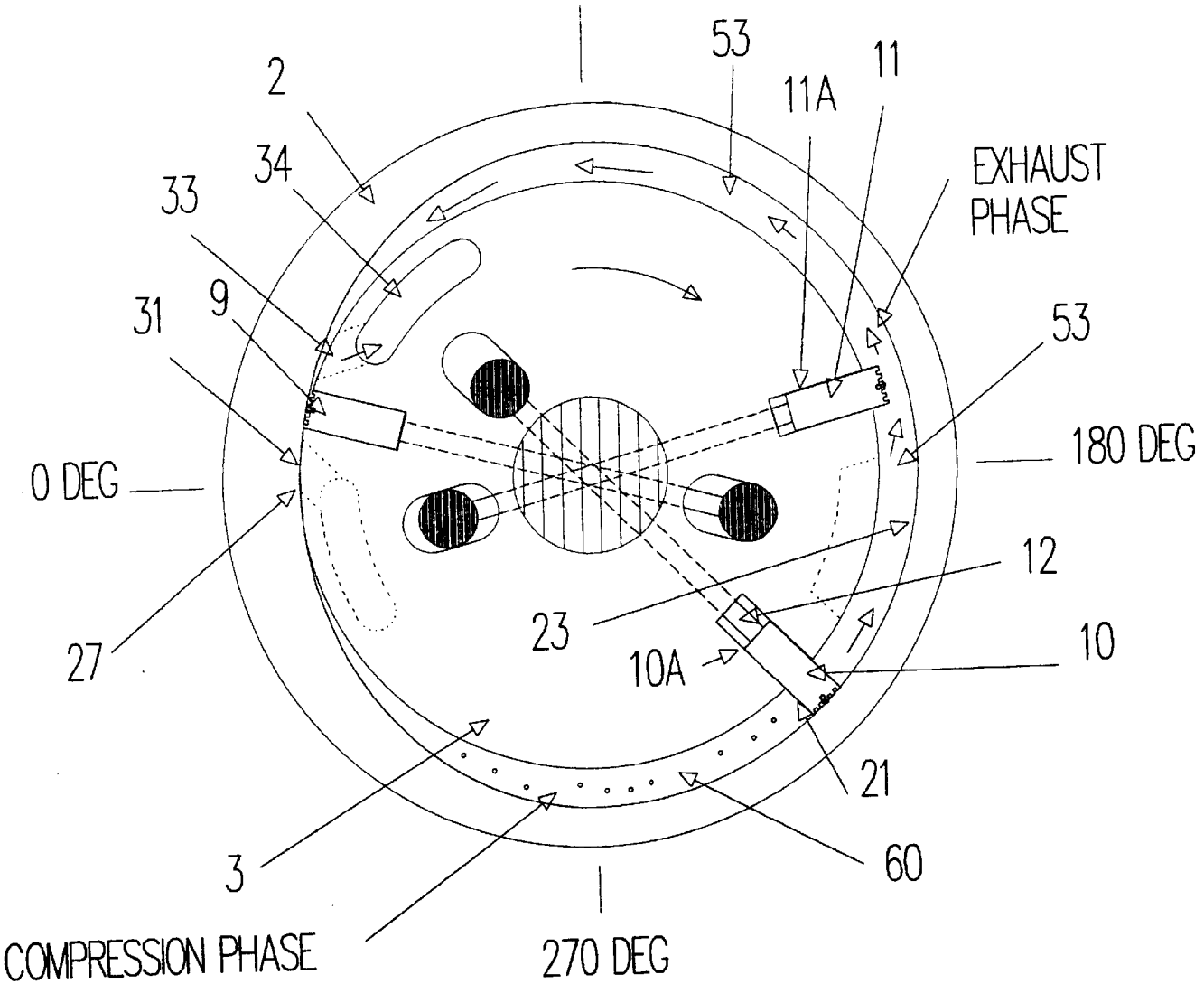
FIG. 9 is a cross-sectional radial view of one embodiment of FIG. 1 showing the torque vane at 225 degrees of rotation.

Referring to FIG. 9, torque vane (10) is at the 225 degree position in a sealed and sliding contact with the inner wall of the rotor chamber (23). As the distance between the surface of the rotor and the inner wall of the rotor chamber decreases, torque vane (10) retracts into its slot (10A). The volume of the compression chamber (60) is now defined as the volume between the rotor/rotor casing seal (27) and the leading face (21) of torque vane (10). Note that pressure containment vane (11) commences its extraction from its slot (11A). Intake/exhaust vane (9) has swept over seal (27) and is substantially in its fully retracted position.

Referring to FIG. 3, torque vane (10) is at the 270 degree position and compression chamber (60) is approaching its minimum volume. The fuel/air mixture within the compression chamber (60) is reaching its maximum pressure. Pressure containment vane (11) is fully extended from slot (11A) and its tip is in a sliding and sealed contact with the inner wall of the rotor chamber. The space between the lagging face (22) of torque vane (10) and the leading face (26) of pressure containment vane (11) and the volume formed by the hollow (30) comprise the combustion chamber (52).

Referring to FIG. 4, torque vane (10) has commenced its retraction in slot (10A). As torque vane (10) retracts, the pressurized air/fuel mixture is further compressed within compression chamber (20).

The Combustion Phase and Power Phase

Referring to FIG. 5, torque vane (10) is at the "0" degree position (27) and fully retracted. The pressurized fuel/air mixture has now been transferred to the combustion chamber (52).

Referring to FIG. 6, the combustion chamber (52) containing the pressurized fuel/air mixture is at the "0" degree position (27) and directly below the spark plug (28). The spark plug fires and ignites the fuel/air mixture which combusts and the products of combustion begin to expand, commencing the power phase of engine operation.

Referring to FIG. 2, during the power phase of engine operation the products of combustion will expand to fill the combustion chamber (52). The gases will be expanding against the rotor casing/ rotor seal (27) as well as the lagging face (22) of torque vane (10), however, since the area represented by the lagging face (22) of torque vane (10) is greater than the area presented by the seal (27) the gases will drive the vane in a clock-wise direction imparting rotational torque to the rotor (3) in the direction after the arrow (200). Pressure containment vane (11) remains retracted into its slot (11A) after passing rotor casing/rotor seal (27).

Referring to FIG. 8, the torque vane (10) is in the 180 degree position. The combustion gases in combustion chamber (52) continue to act against the lagging face (22) of torque vane (10). Therefore, one of the main advantages of this engine cycle is that power is transmitted to the torque vane by the expanding gases over at least 180 degrees of engine rotation as many as 200 degrees of engine rotation thus increasing the overall torque of the engine.

The Exhaust Phase

Referring to FIG. 9, the exhaust phase of engine operation commences when torque vane (10) is located at the 225 degree position. The pressure containment vane (11) begins to extend from slot (11A) as the intake/exhaust vane (9) sweeps past the rotor casing/rotor seal (27) at the "0" degree position. Exhaust gas chamber (53) is near its maximum volume and exhaust gas is forced into exhaust orifice (33) and into exhaust port (34). Exhaust port (34) is in communication with the exhaust annulus (Shown in FIG. 10 as Item 34A) and exhaust gases are driven out of the rotor chamber through exhaust tubes (Shown in FIG. 10 as Item 36).

Referring to FIG. 3 intake/exhaust vane (9) is sweeping towards the 90 degree position and pressure containment vane (11) is sweeping towards the 270 degree position. The tops of both vanes are in sliding and sealing contact with the inner wall of the rotor chamber. The exhaust chamber (53) is defined as that volume enclosed by the lagging face (26A) of the pressure containment vane (11) and the leading face (25) of the exhaust/intake vane (9).

Referring to FIG. 5, intake/exhaust vane (9) is sweeping towards the 180 degree position and pressure containment vane (11) is sweeping towards the "0" degree position. The volume of the exhaust chamber (53) gets smaller as the rotor rotates and exhaust gases are forced into the exhaust orifice (33).

Referring to FIG. 2, pressure containment vane (11) has swept past the rotor/rotor casing seal (27) and the volume of the exhaust chamber (53) is now defined as that volume between the leading face (25) of the intake/exhaust vane (9) and the rotor/rotor casing seal (27). As the rotor continues to rotate clockwise the exhaust gases will be forced into the exhaust orifice (33) until all exhaust gas is forced out of the exhaust chamber as intake/exhaust vane (9) sweeps past seal (27). Once intake/exhaust vane (11) sweeps beyond seal (27), the exhaust port (34) will no longer be in communication with exhaust annulus (Shown in FIG. 1 as Item 34A).

Figure 11:
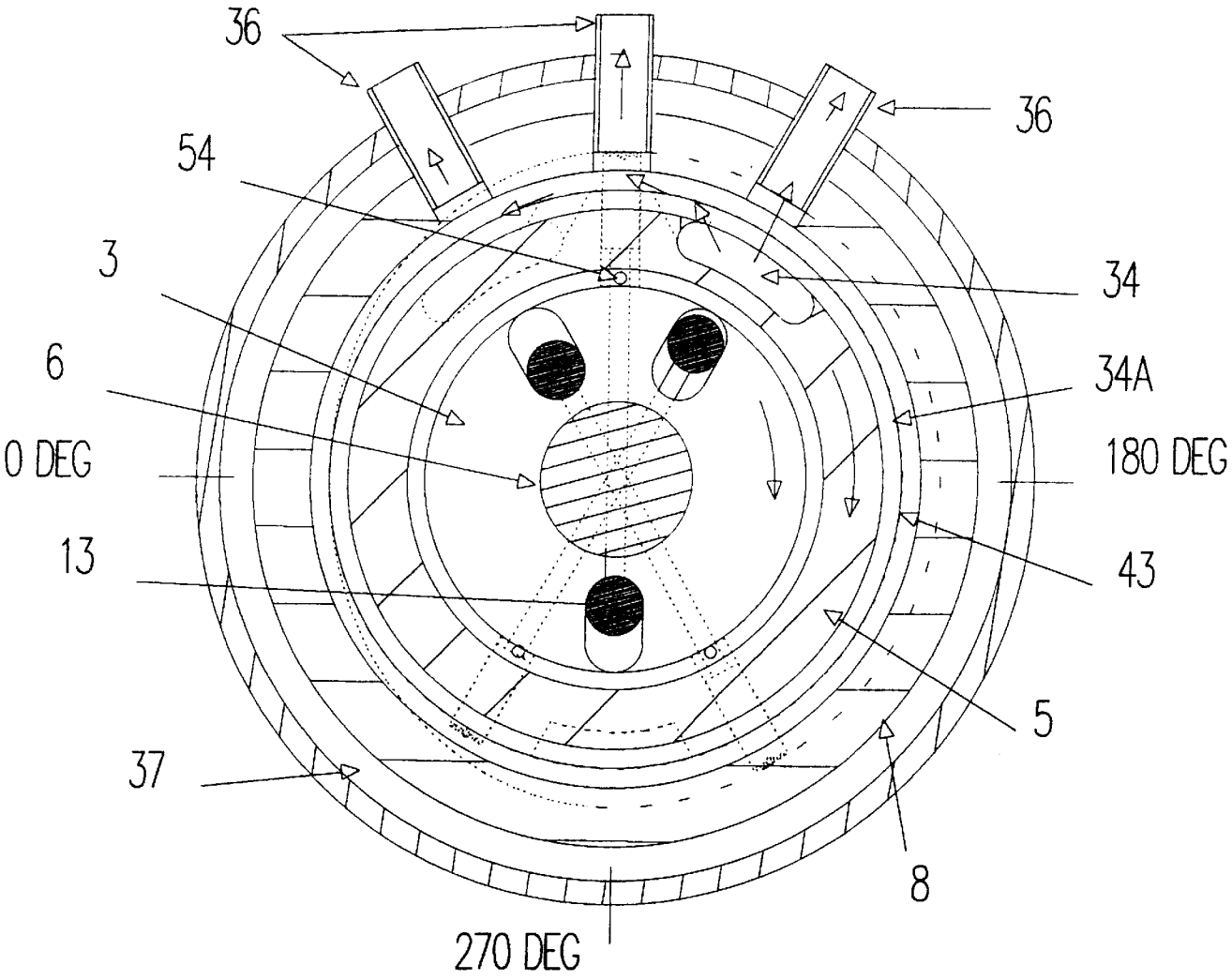
FIG. 11 is a cross-sectional radial view of one embodiment of FIG. 1 showing the flow of exhaust gases.

Additional details of the exhaust phase are described with reference to FIG. 10 and FIG. 11. FIG. 10 shows the leading face (25) of intake/exhaust vane (9) coming toward the viewer. As the rotor (3) rotates exhaust gases are forced into exhaust orifices (33) and rotor exhaust port (34). During the exhaust phase, exhaust port (34) is in constant communicating with exhaust annulus (34A). Exhaust tubes (36) penetrate exhaust casing (8) and are in constant communication with the exhaust annulus (34A) thus there is a direct pathway for exhaust gases to be forced out of the exhaust chamber. In FIG.1, three exhaust tubes (36) are shown penetrating exhaust casing (8) and in communication with exhaust annulus (34A). Rotor exhaust port (34) is in communication with the exhaust annulus (34A) during the exhaust phase. Shown in FIG. 11 is exhaust ring (5) which bounds exhaust annulus (34A).

Cams and Cam Pathways

The operable relationship between the cams, Cam axles and cam pathways is described below.

Figure 12:
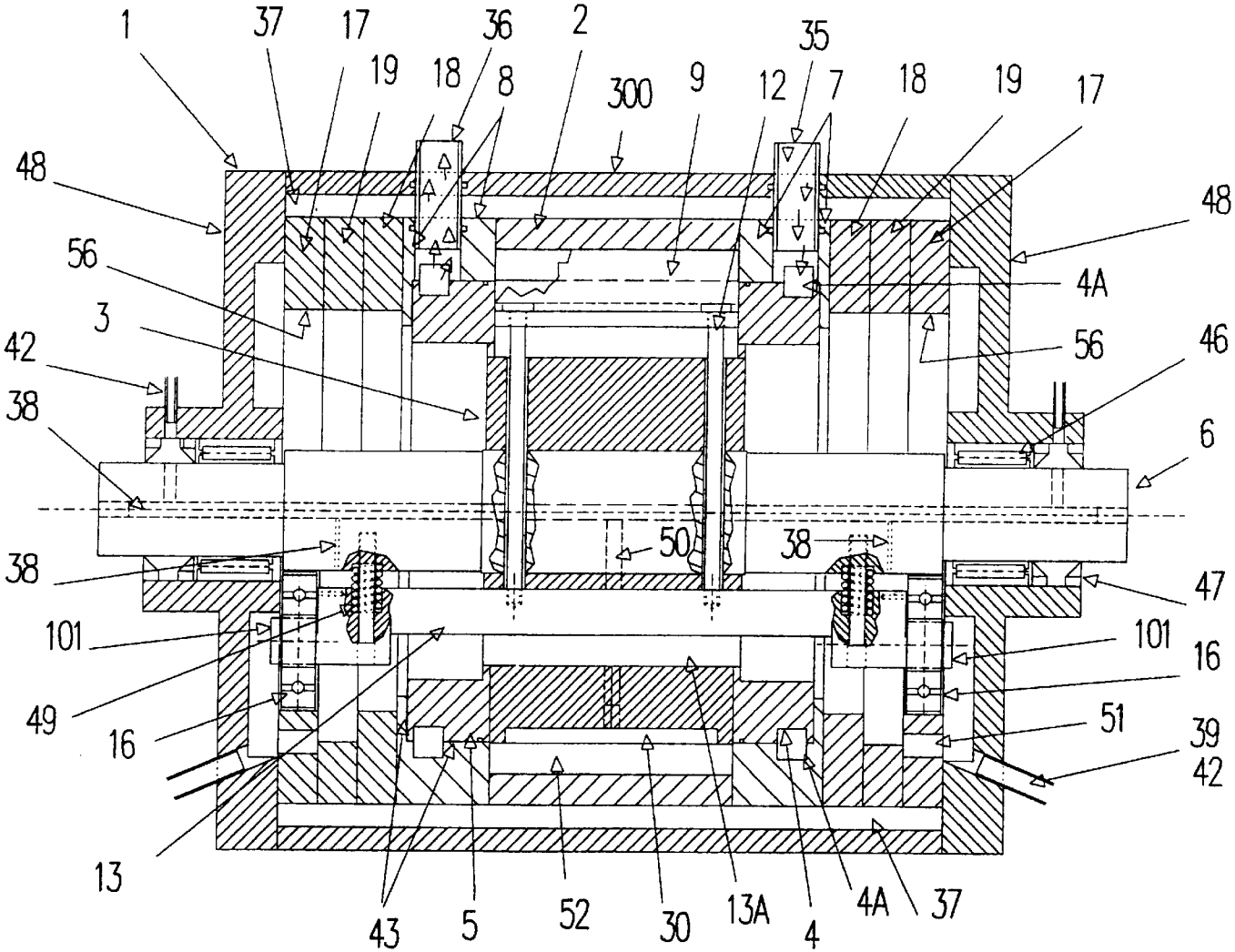
FIG. 12 is a cross-sectional radial view of one embodiment of FIG. 1.

Referring to FIG. 12, the intake/exhaust vane (9) is shown at the 90 degree position, in its fully extended position, and in sliding and scaling contact with the inner wall of the rotor casing (2). Combustion chamber (52) is shown at the 270 degree position. Intake/exhaust vane (9) is attached to a pair of rods (12). Rods (12) penetrate the rotor (3) and drive shaft (6) through ducts (44) sufficiently sized to permit the passage of the rods (12) and adequate lubrication of the rods within the ducts. Rods (12) are attached at their other ends to cam axle (13) which is shown housed in bore (13A). Coinciding with the maximum extension of intake/exhaust vane (9) cam axle (13) is shown at its inboard position in bore (13A). As is apparent from FIG. 12, the motion of the vane (9) is determined by the motion of the cam axle (13) in the axle bore (13A). The reciprocating cam axle (13) is biased by spring (49).

Figure 13:
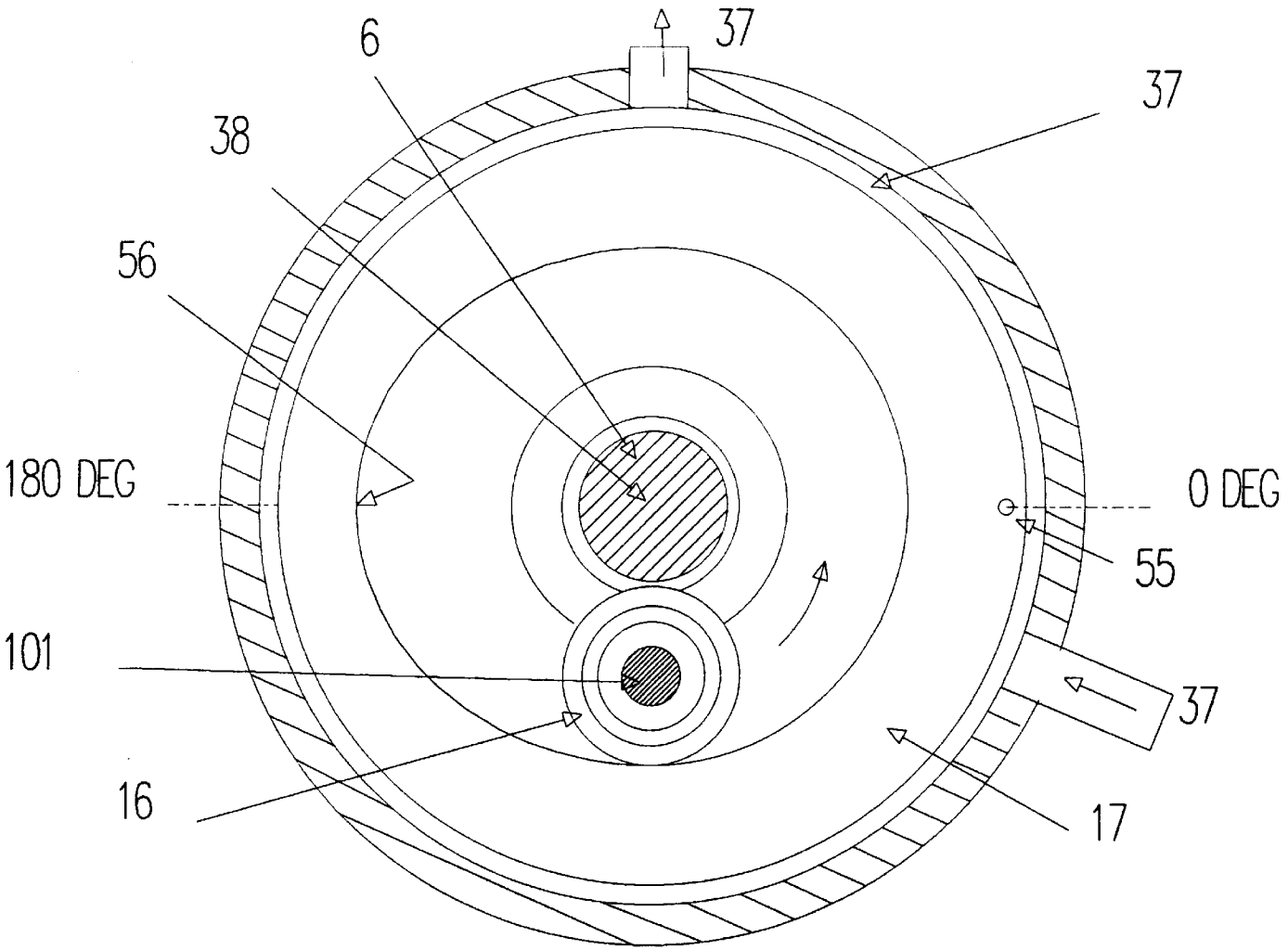
FIG. 13 is a cross sectional radial view of one embodiment of FIG. 1 showing cam 17.

Cam pathway (17) is illustrated in FIG. 12 and FIG. 13. Lug (101) is shown mounting anti-friction bearing (16). Lug (101) and bearing (16) follow the pathway defined by cam surface (56). As shown in FIG. 2, when the anti-friction bearing (16) is at the 180 degree position in its rotation, the cam axle will be forced against its spring (49) to its inboard position in the cam axle bore which will coincide with the vane (9) being at its fully extended position.

Figure 14:
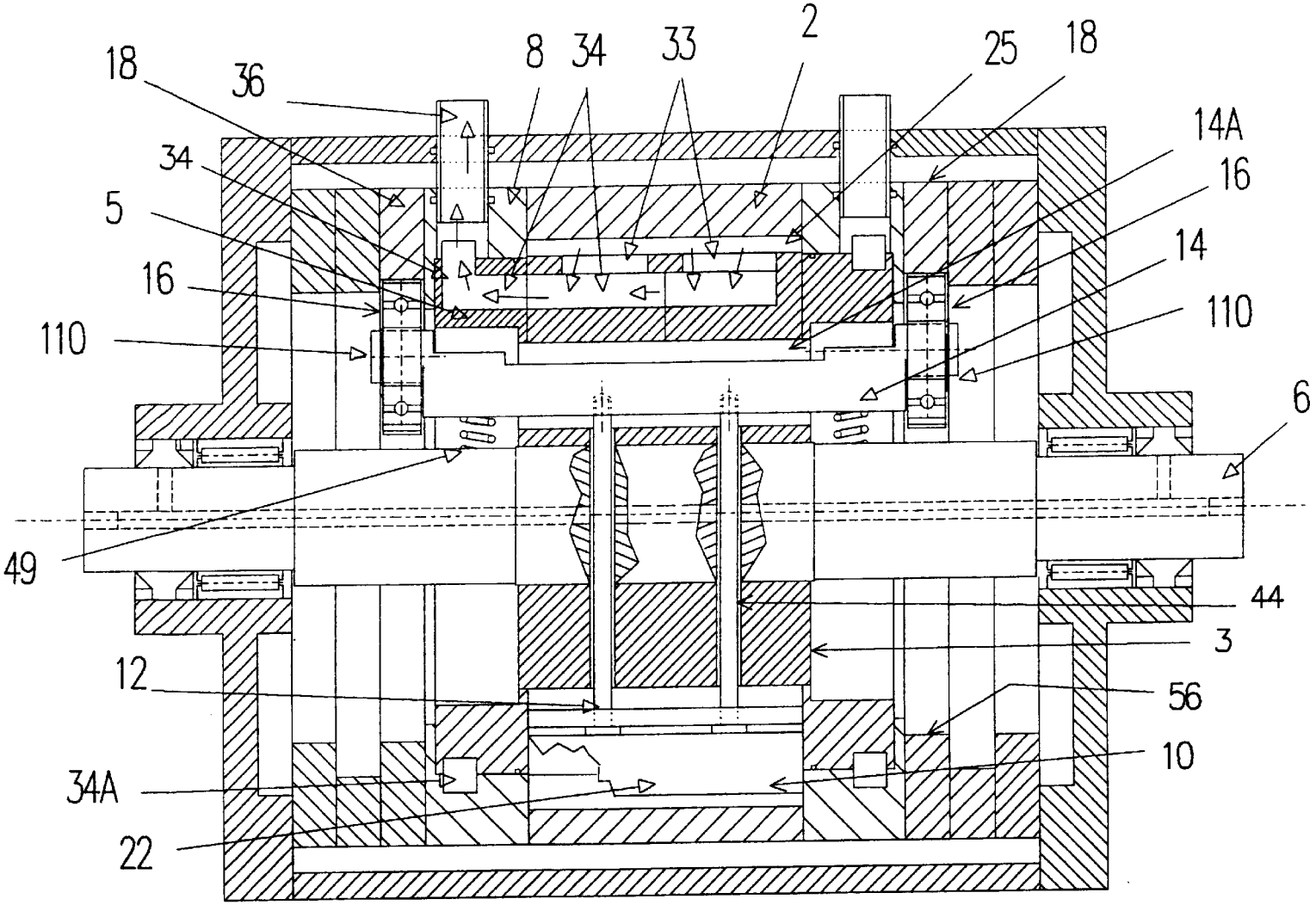
FIG. 14 is a cross-sectional axial view of one embodiment of FIG. 1
Figure 15:
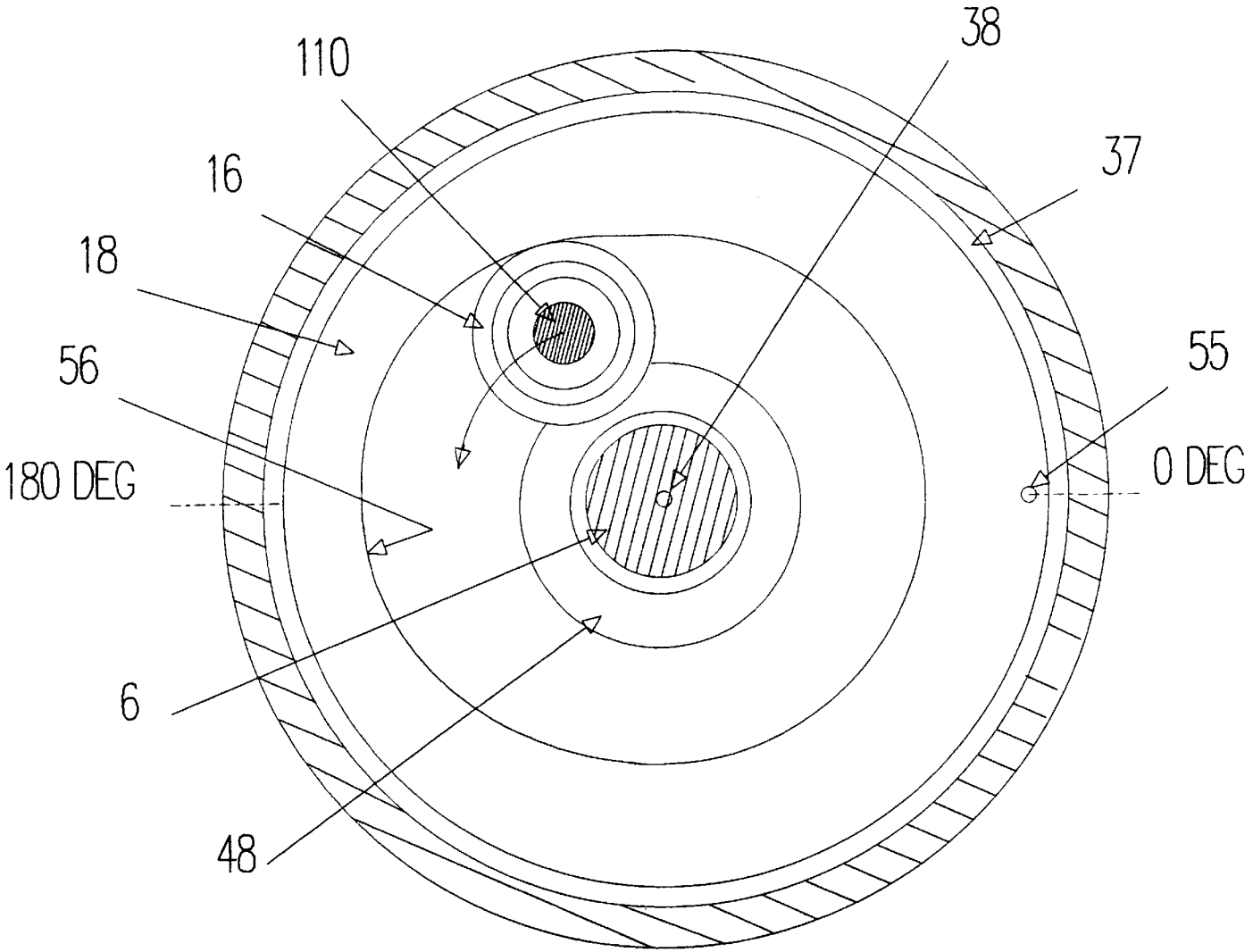
FIG. 15 is a cross-sectional radial view of one embodiment of FIG. 1 showing cam 18.

The operative relationship between the torque vane (10) and its cam axle (14) is similarly described with reference to FIG. 14 and FIG. 15. Torque vane (10) is shown at its 270 degree position. Facing the viewer is the lagging face (22) of torque vane (10) moving away from the viewer. Torque vane (10) is attached to cam axle (14) by way of a pair of rods (12) which penetrate both the rotor (3) and the main shaft (6) by way of ducts (44) which are adequately lubricated. The torque vane (10) is shown in a partially extended position and therefore cam axle (14) is shown at its inboard position within its axle bore (14A) and compressed against spring (49). Lug (110) is illustrated mounting anti-friction bearing (16). Anti-friction bearing (16) is shown in cam pathway (18). The operative relationship between the cam axle (14) and the cam pathway (18) is illustrated in FIG. 15 where lug (110) attached to cam axle (14) is shown mounting anti-friction bearing (16). Bearing (16) is in rotational engagement with cam surface (56) and as the rotor rotates cam surface determines the position of cam axle (14) within its bore (14A) and therefore the position of torque vane (10).

Figure 16:
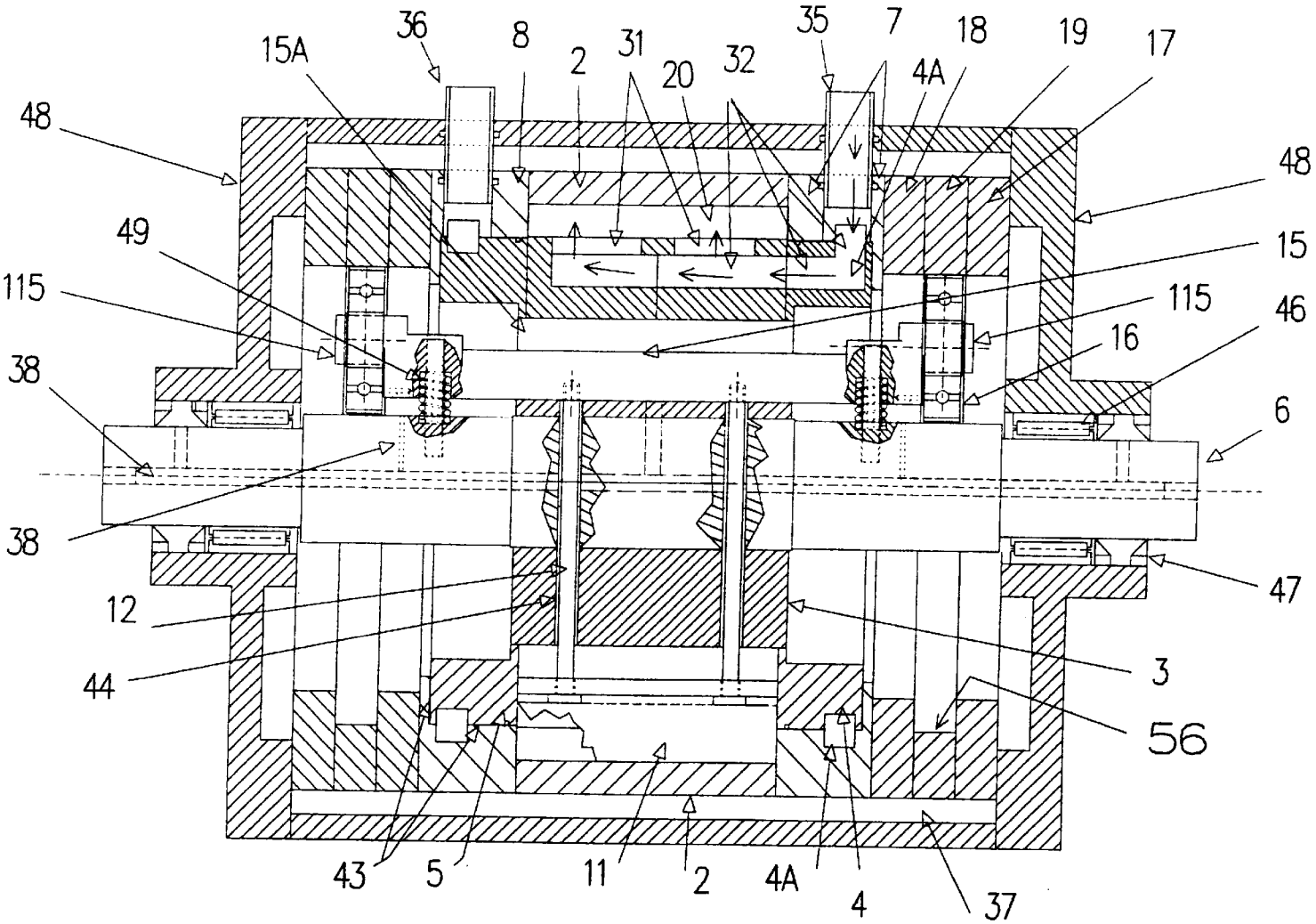
FIG. 16 is a cross-sectional axial view of one embodiment of FIG. 1.
Figure 17:
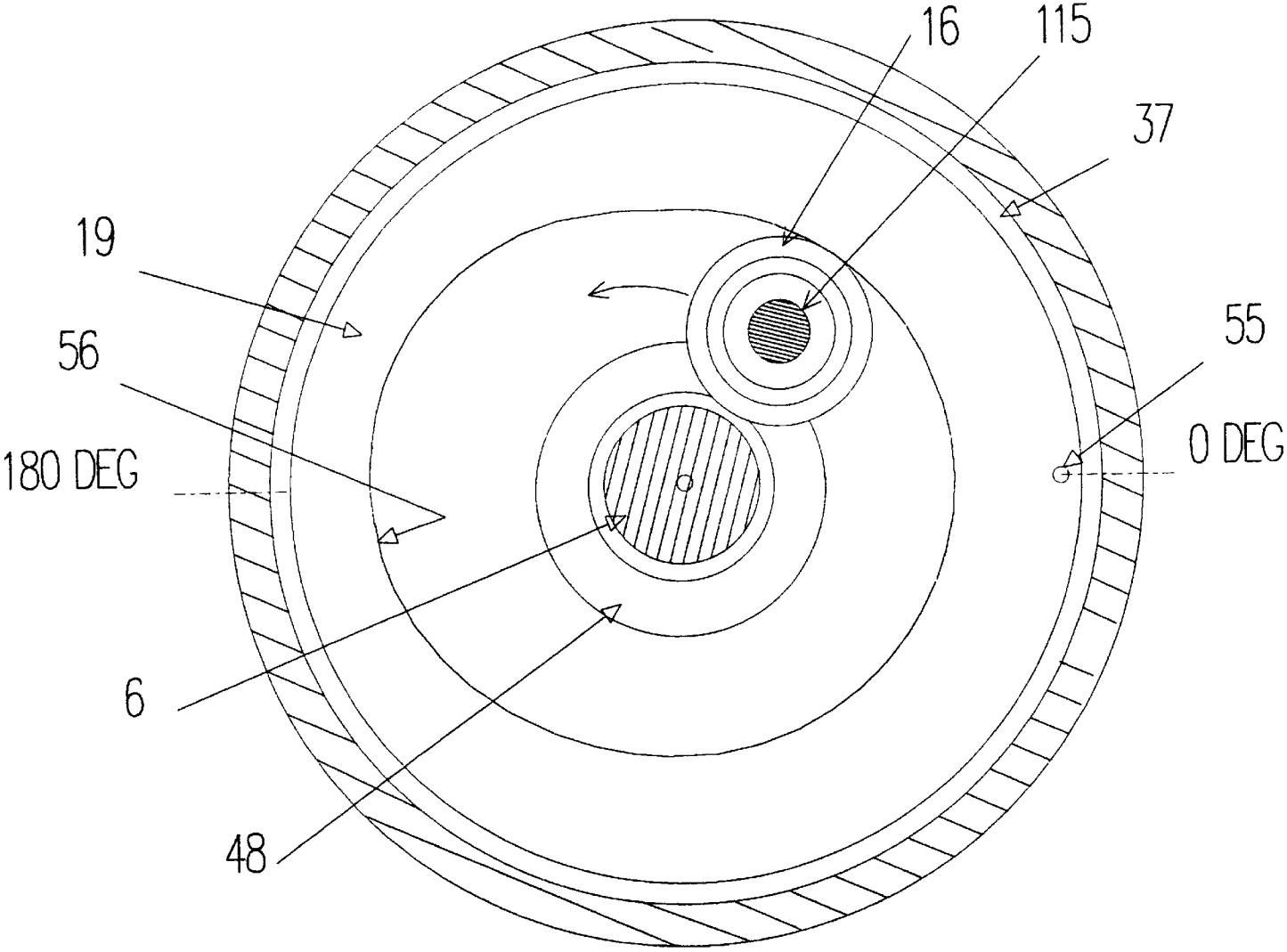
FIG. 17 is a cross-sectional radial view of one embodiment of FIG. 1 showing cam 19.

The operative relationship between pressure containment vane (11), cam axle (15) and cam (19) is described with reference to FIG. 16 and FIG. 17. Pressure containment vane (11) is shown at its 270 degree position and fully extended so that its tip is in slidable and sealing contact with the inner surface of the rotor chamber (2). Pressure containment vane (11) is connected to cam axle (15) by way of a pair of rods (12) penetrating rotor (3) and drive shaft (6) through ducts (44). Ducts (44) also provide lubrication for the rods (12). Since pressure containment vane (11) is at its maximum extension, cam axle (15) must be at its maximum inboard position within cam axle bore (15A) and compressed against spring (49). Lug (115) is shown mounted to cam axle (15) anti-friction bearing (16) is shown mounted to lug (115). The operative relationship between lug (115), anti-friction bearing (16) and cam (18) is described with reference to FIG. 17. FIG. 17 illustrates lug (115) mounting anti-friction bearing (16). Anti-friction bearing (16) is in a rotating engagement with cam surface (56). As the rotor rotates, lug (115) and bearing (16) travel cam path (56). Lug (115) transmits its rotational movement as reciprocating movements of cam axle (15) within axle bore (15A). This reciprocating movement is transferred to pressure containment vane (11) by way of connecting rods (12).

Figure 18:
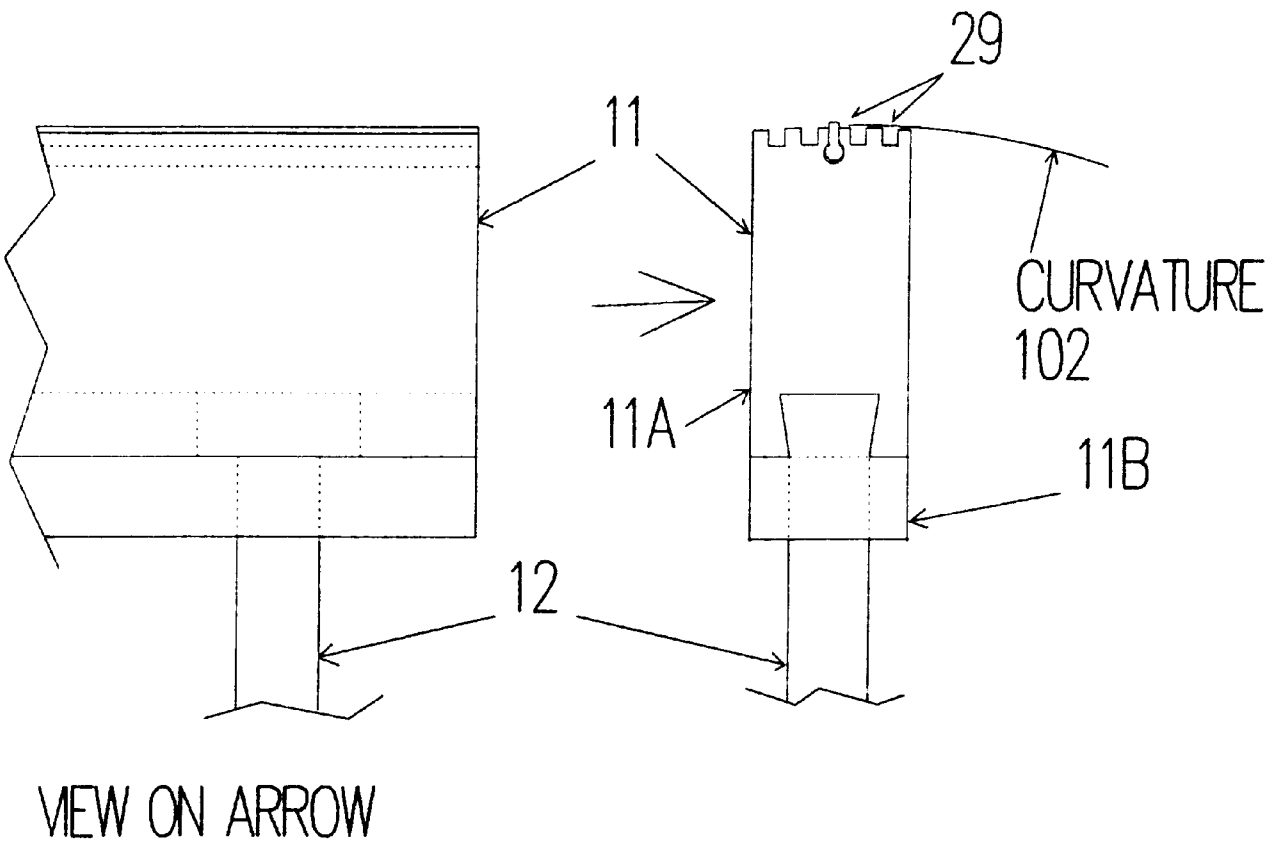
FIG. 18 is a front and side view of one embodiment of a vane of one embodiment of FIG. 1.

Referring to FIG. 18, the slidable and retractable vanes (of which (11) is shown) comprise rectangular members. With a thickness sufficient to provide for adequate sealing between the working chambers of the engine when the vanes are in their extended positions and allow the mounting of sealing means thereon. As described above, the vanes are connected to cam axles by rods (12) that transmit the reciprocating motion of the cam axels to the vanes as the engine rotates. The vanes (9, 10 and 11) are mounted at their inboard ends to said rods (12) by a dovetail attachment (11B). A seal (29) is mounted to the outboard ends of the vanes so that the vane can remain in sliding contact with the inside surface of the rotor chamber. The seals may consist of one of or a combination of a labyrinth, an inorganic seal or a TEFLON™ key and the tip of the sealing and anti-friction means are curved (102) to coincide with the curvature of the inside surface of the rotor chamber.

It will be understood by a person skilled in the art that a seal must be provided to maintain the proper gas and fluid pressures within the operating engine. Seals shown in the figures include: rotor/rotor casing seal (Shown in FIG. 2 as Item 27), vane tip seal (Shown in FIG. 18 as Item 29), labyrinth, TEFLON™ or polymer seal (Shown in FIG. 1 as Item 43) and oil seal (Shown in FIG. 1 as Item 47).

Figure 19:
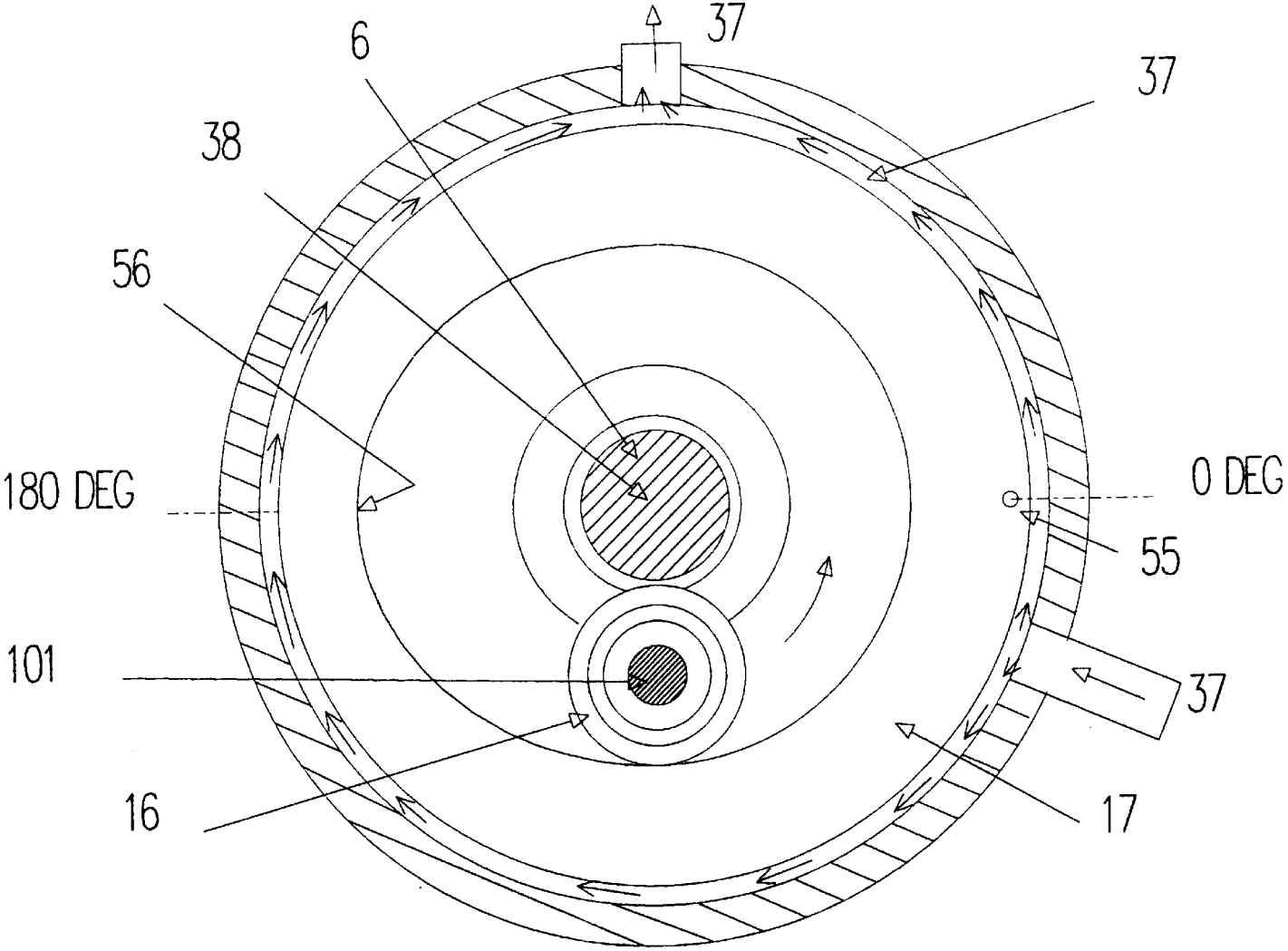
FIG. 19 is a cross-sectional radial view of one embodiment of FIG. 1 showing the liquid coolant jacket.

It will be understood by a person skilled in the art that an adequate heat rejection system must be provided in order to remove the heat of fuel combustion from the engine. Referring to FIGS. 1 and 19, a liquid coolant jacket (37) is shown between the outer casing of the engine assembly (1) and the engine rotor casing (2). It will be further understood by a person skilled in the art that the coolant will circulate through its jacket under pressure and therefore be connected to a coolant pump.

The rejected heat will be transported by the coolant from the engine to a radiator in a closed loop system.

It will be understood by a person skilled in the art that adequate lubrication must be provided between those moving parts which are in sliding or frictional contact with each other. The present invention discloses a plurality of lubricating devices which, referring to the figures include: oil feed passage through the shaft/rotor/cam axles (Shown in FIG. 1 as Item 38), oil scavenge system (Shown in FIG. 1 as Item 39), oil lines communicating with a pumping heat rejection system (Shown in FIG. 1 as Item 42) to provide for oil cooling, oil seal (Shown in FIG. 1 as Item 47), rotor oil cooling passage (Shown in FIG. 1 as Item 50) and oil drain passage through the intake exhaust cam (Shown in FIG. 1 as Item 51).

It will be further understood by a person skilled in the art that spark ignition timing and rotor balancing will be provided.

The embodiments of the invention for which an exclusive privilege or property is claimed are defined as follows:

1. A rotary internal combustion engine comprising:

an engine casing, sealed at opposite ends by sealing means;

a cylindrical rotor chamber located in said engine casing;

a drive shaft co-axially disposed in said cylindrical rotor chamber;

a cylindrical rotor rotatably disposed within said cylindrical rotor chamber and fixed to said drive shaft;

said rotor having a plurality of radially extending reciprocating vanes disposed in a staggered arrangement;

said rotor having one point in a continuous sliding and sealing contact with one point of the inside wall of the said cylindrical rotor chamber;

a plurality of cam axles connected to said plurality of reciprocating vanes by connecting means;

mounting lugs integral to each end of said plurality of cam axles;

friction bearing means rotatably mounted to each of said mounting lugs;

a plurality of cam pathways wherein the said friction bearing means are slidably engaged so that the movement of the said friction bearing means in the said cam pathways imparts a reciprocating motion to said reciprocating vanes thus defining the working chambers of the engine as the rotor rotates within the rotor chamber, said working chambers being the fuel/air mixture intake chamber; the fuel/air compression chamber; the combustion chamber; and, the exhaust chamber;

a fuel/air mixture supply means penetrating the said engine casing and connected to said fuel/air intake chamber;

a fuel/air mixture ignition means penetrating the said engine casing and connected to said combustion chamber;

an exhaust gas removal means penetrating said engine casing and connected to said exhaust chamber;

said rotor having intake and exhaust ports disposed therein, in communication with said fuel/air mixture supply means, and exhaust gas removal means, a heat of combustion removal means penetrating said engine casing and surrounding said cylindrical rotor chamber and said cam pathways and connected to an external coolant recirculating means and external heat radiation means;

a plurality of sealing means fixed to the tips of each of the said reciprocating vanes for pressure sealing the various working chambers of the engine from each other;

a plurality of sealing means for sealing the said drive shaft in the said engine casing;

a plurality of lubrication means for lubricating all of the moving parts of the engine; and wherein, for each 360 degrees of rotation of said rotor there is a fuel/air mixture intake phase; a fuel/air mixture compression phase; a combustion and power phase; and an exhaust gas removal phase.

2. A rotary internal combustion engine as claimed in claim 1, wherein said engine casing is sealed at its opposite ends by plates.

3. A rotary internal combustion engine as claimed in claim 2, wherein said plates are apertured at their center line, said aperture having bearing, sealing and lubricating means therein to support, seal and lubricate the ends of said drive shaft protruding therefrom.

4. A rotary internal combustion engine as claimed in claim 3, wherein said rotor is slotted in a radial and staggered arrangement to receive said reciprocating vanes.

5. A rotary internal combustion engine as claimed in claim 4, wherein said rotor is adapted to receive said cam axles by way of a plurality of axially aligned bores.

6. A rotary internal combustion engine as claimed in claim 5, wherein each of said bores is positioned radially and in an operative arrangement with each of the said slots.

7. A rotary internal combustion engine as claimed in claim 6, wherein each of said bores is in the shape of a rectangle with curved ends to permit the reciprocating motion of the cam axles.

8. A rotary internal combustion engine as claimed in claim 7, wherein each of said bores is connected to each of said slots by a plurality of ducts, each duct adequately sized to receive connecting means between the said cam axles housed in the said bores and the said vanes housed in said slots and to permit adequate lubrication thereof.

9. A rotary internal combustion engine as claimed in claim 8, wherein said connecting means comprise a plurality of rods; said rods transmitting the reciprocating motion of the cam axles to the said vanes.

10. A rotary internal combustion engine as claimed in claim 9, wherein said cam axles are biased towards their outboard positions within their respective bores by biasing means.

11. A rotary internal combustion engine as claimed in claim 10 wherein said reciprocating vanes comprise rectangular members adapted to be received within the slots of said rotor in a sliding contact to permit their reciprocating motion.

12. A rotary internal combustion engine as claimed in claim 11 wherein said reciprocating vanes, when in their fully extended position, and in a sliding and sealing contact with the inner surface of the rotor chamber, form division-members between the working chambers of said engine.

13. A rotary internal combustion engine as claimed in claim 12, wherein a distal surface of said reciprocating vanes provides a pressure seal, between said distal surface and inner wall of said rotor chamber.

14. A rotary internal combustion engine as claimed in claim 13, wherein said cam means comprise a single cam axle for each respective reciprocating vane.

15. A rotary internal combustion engine as claimed in claim 14, wherein said cam axles mount integral lugs at their distal ends.

16. A rotary internal combustion engine as claimed in claim 15, wherein each of said lugs mount bearing means.

17. A rotary internal combustion engine as claimed in claim 16, wherein each of said bearing means are circular bearings in sliding and rotating engagement with its respective cam pathway.

18. A rotary internal combustion engine as claimed in claim 17, wherein said reciprocating motion of the said vanes is defined by the rotating movement of said bearing means around their cam pathways.

19. A rotary internal combustion engine as claimed in claim 18, wherein said fuel/air mixture supply means comprises one of either a fuel injection means or a fuel aspiration means.

20. A rotary internal combustion engine as claimed in claim 19, wherein said fuel/air ignition means comprises one of either a spark ignition means or a compression means.

21. A rotary internal combustion engine as claimed in claim 20, wherein an intake/exhaust vane, when fully extended, defines the boundary between the intake chamber of the engine and the exhaust chamber of the engine.

22. A rotary internal combustion engine as claimed in claim 21, wherein the exhaust chamber of the engine is defined by the volume between the point of sliding contact between the rotor and rotor casing and the leading face of the intake/exhaust vane such that as the rotor rotates said volume decreases forcing exhaust gases into the exhaust means.

23. The rotary internal combustion engine of claim 22 wherein a torque vane defines the boundary between the combustion chamber of the engine and the intake chamber of the engine.

24. A rotary combustion engine as claimed in claim 1, wherein said plurality of reciprocating vanes comprises an intake/exhaust vane, a torque vane, and a pressure containment vane.

25. The rotary combustion engine as claimed in claim 24 wherein the rotation of from about 0° through to about 240° of said intake/exhaust vane, during which a fuel/air mixture enters said intake chamber, comprises an intake phase.

26. The rotary combustion engine as defined in claim 24 wherein the rotation of from about 180° through to about 0° of said torque vane, during which said fuel/air mixture is compressed within said compression chamber, comprises a compression phase.

27. The rotary combustion engine as defined in claim 24 wherein the rotation of from about 0° through to about 225° of said torque vane, during which said fuel/air mixture is ignited within said combustion chamber and expands forming an exhaust gas, comprises a combustion and power phase.

28. The rotary combustion engine as defined in claim 27 wherein following formation of said exhaust gas, said pressure containment vane retracts within said rotor.

29. The rotary combustion engine as defined in claim 24 wherein the rotation of from about 225° through to about 0° of the torque vane, during which time said exhaust gas is removed from the exhaust chamber, comprises an exhaust phase.

* * * * *